US012035852B2

(12) United States Patent
McCain

(10) Patent No.: US 12,035,852 B2
(45) Date of Patent: Jul. 16, 2024

(54) TOWEL FASTENER

(71) Applicant: Joshua McCain, Lexington, NC (US)

(72) Inventor: Joshua McCain, Lexington, NC (US)

( * ) Notice: Subject to any disclaimer, the term of this patent is extended or adjusted under 35 U.S.C. 154(b) by 302 days.

(21) Appl. No.: 17/394,718

(22) Filed: Aug. 5, 2021

(65) Prior Publication Data

US 2022/0053980 A1 Feb. 24, 2022

Related U.S. Application Data

(60) Provisional application No. 63/067,274, filed on Aug. 18, 2020.

(51) Int. Cl.
*A47K 10/14* (2006.01)

(52) U.S. Cl.
CPC ..... *A47K 10/14* (2013.01)

(58) Field of Classification Search
CPC ..... A47K 10/14
USPC ..... 248/340, 317, 320, 323
See application file for complete search history.

(56) References Cited

U.S. PATENT DOCUMENTS 2,039,620 A * 5/1936 Bear ..... A47K 10/12 24/515
2,310,827 A * 2/1943 Anderson ..... B65D 77/185 24/30.5 R
2,320,308 A * 5/1943 Silverman ..... A47H 15/00 160/390
2,585,398 A * 2/1952 McIlwraith ..... B60N 2/62 24/339
3,137,027 A * 6/1964 Birkle ..... A47H 13/01 24/456
3,529,328 A * 9/1970 Davison ..... A47G 25/485 24/303
4,024,997 A * 5/1977 Kolpin ..... F41C 33/06 294/142
4,258,493 A * 3/1981 Kettlestrings ..... G09F 1/10 24/339
5,109,912 A * 5/1992 Gary ..... A47H 13/14 160/84.01
5,282,292 A * 2/1994 Levy ..... A47H 15/02 16/95 D
5,441,789 A 8/1995 Walker
(Continued)

FOREIGN PATENT DOCUMENTS

FR 801083 * 7/1936

*Primary Examiner* — Kimberly T Wood
(74) *Attorney, Agent, or Firm* — Boudwin Intellectual Property Law, LLC; Daniel Boudwin

(57) ABSTRACT

A towel fastener is provided. The device includes a flexible strap having a first end opposite a second end. A pair of fastener plates is hingedly affixed to a first end of the flexible strap. The pair of fastener plates are movable between an open position and a closed position, wherein the pair of fastener plates are parallel when in the closed position. A complementary fastener is disposed on each of the pair of fastener plates, such that the pair of fastener plates are removably securable in the closed position. In one embodiment, a clasp is slidably positioned over the flexible strap and removably secures the flexible strap in a looped configuration about a support surface. In another embodiment, a tongue is disposed on the flexible strap, wherein the tongue slidably secures within a track system. In other embodiments, a towel is integrally affixed to a pair of towel fasteners.

7 Claims, 4 Drawing Sheets

(56) References Cited

U.S. PATENT DOCUMENTS

| | | | | |
|---|---|---|---|---|
| 5,682,653 | A * | 11/1997 | Berglof | G09F 1/10 224/183 |
| 5,743,450 | A * | 4/1998 | Plate | A45F 5/00 224/267 |
| 6,836,899 | B1 * | 1/2005 | Glasmire | A45F 5/04 24/9 |
| 9,078,510 | B2 * | 7/2015 | Liao | A45F 5/10 |
| 9,249,814 | B2 * | 2/2016 | Tsai | A45F 5/02 |
| 11,129,504 | B2 * | 9/2021 | Gamblin | F16M 13/022 |
| 11,129,507 | B2 * | 9/2021 | Martinez Manjarrez | A47K 13/22 |
| 11,484,067 | B2 * | 11/2022 | Dubose | A44B 18/0003 |
| 2005/0204501 | A1 | 9/2005 | Golec | |
| 2008/0104807 | A1 * | 5/2008 | Hosfeld | A47C 21/022 24/455 |
| 2012/0137431 | A1 | 6/2012 | Pittman | |
| 2012/0242126 | A1 | 9/2012 | Burns | |
| 2012/0299674 | A1 * | 11/2012 | Montone | H01F 7/0221 335/285 |
| 2016/0324374 | A1 | 11/2016 | Livingston | |
| 2021/0325692 | A1 * | 10/2021 | Baird | A45F 5/00 |

* cited by examiner

TOWEL FASTENER

CROSS REFERENCE TO RELATED APPLICATIONS

This application claims the benefit of U.S. Provisional Application No. 63/067,274 filed on Aug. 18, 2020. The above identified patent application is herein incorporated by reference in its entirety to provide continuity of disclosure.

BACKGROUND OF THE INVENTION

The present invention relates to towel securement devices. More particularly, the present invention pertains to a towel fastener securable to a boat or other vehicle to retain a towel in a desired location.

Many individuals enjoy boating and spending time on the water; however, such individuals are keenly aware of the discomfort of sitting on hot boat seats after hours in the sun. While the heat itself can be uncomfortable, so is the feeling of the seat adhering to the user's skin. Often, individuals use towels to place on the boat seat to minimize this discomfort, however towels are prone to being displaced by wind or movement of the boat. Keeping track of the towel and ensuring that it stays in the desired location can be an extremely frustrating experience that lessens the user's enjoyment of being on the water. Therefore, a device that can secure a towel in a desired position along the boat is desired.

In light of the devices disclosed in the known art, it is submitted that the present invention substantially diverges in design elements from the known art and consequently it is clear that there is a need in the art for an improvement to existing towel securement devices. In this regard, the instant invention substantially fulfills these needs.

SUMMARY OF THE INVENTION

In view of the foregoing disadvantages inherent in the known types of towel securement devices now present in the known art, the present invention provides a towel fastener wherein the same can be utilized for providing convenience for the user when retaining a towel in a desired position on a boat or other vehicle.

The present system comprises a flexible strap having a first end opposite a second end. A pair of fastener plates are hingedly affixed to the first end of the flexible strap, wherein the pair of fastener plates are selectively movable between an open position and a closed position. When in the closed position, the pair of fastener plates are substantially parallel. A complementary fastener of a pair of complementary fasteners is disposed on each of the pair of fastener plates, such that the pair of fastener plates are removably securable in the closed position. In some embodiments, a clasp is slidably positioned over the flexible strap wherein the clasp removably secures the flexible strap in a looped configuration about a support surface. In another embodiment, a tongue is disposed on the flexible strap, wherein the tongue slidably secures within a track system.

In some embodiments, the clasp comprises a loop disposed over the flexible strap and a secondary loop pivotally affixed to the loop, wherein the secondary loop is configured to receive the second end of the flexible strap therethrough. In another embodiment, the flexible strap further comprises a plurality of apertures disposed along a length of the flexible strap, wherein the plurality of apertures is configured to receive an arm pivotally affixed to the loop of the clasp therethrough to retain the flexible strap in the looped configuration. In other embodiments, the tongue comprises a distal end having a larger diameter than each of a central portion of the tongue and a slot defined along the track system. In yet another embodiment, the tongue is removably securable within one of a plurality of apertures disposed along a length of the flexible strap. In some embodiments, the track system comprises a channel having an interior portion larger than an exterior portion of the channel. In another embodiment, the pair of complementary fasteners comprise magnetic fasteners. In other embodiments, the pair of complementary fasteners are disposed within a central recess of each fastener plate, such that the pair of complementary fasteners rest flush with an interior surface of each fastener plate. In yet another embodiment, the pair of fastener plates comprise a larger cross-sectional area than each of the pair of complementary fasteners. In some embodiments, the second end of the flexible strap tapers to a width less than that of the first end of the flexible strap.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
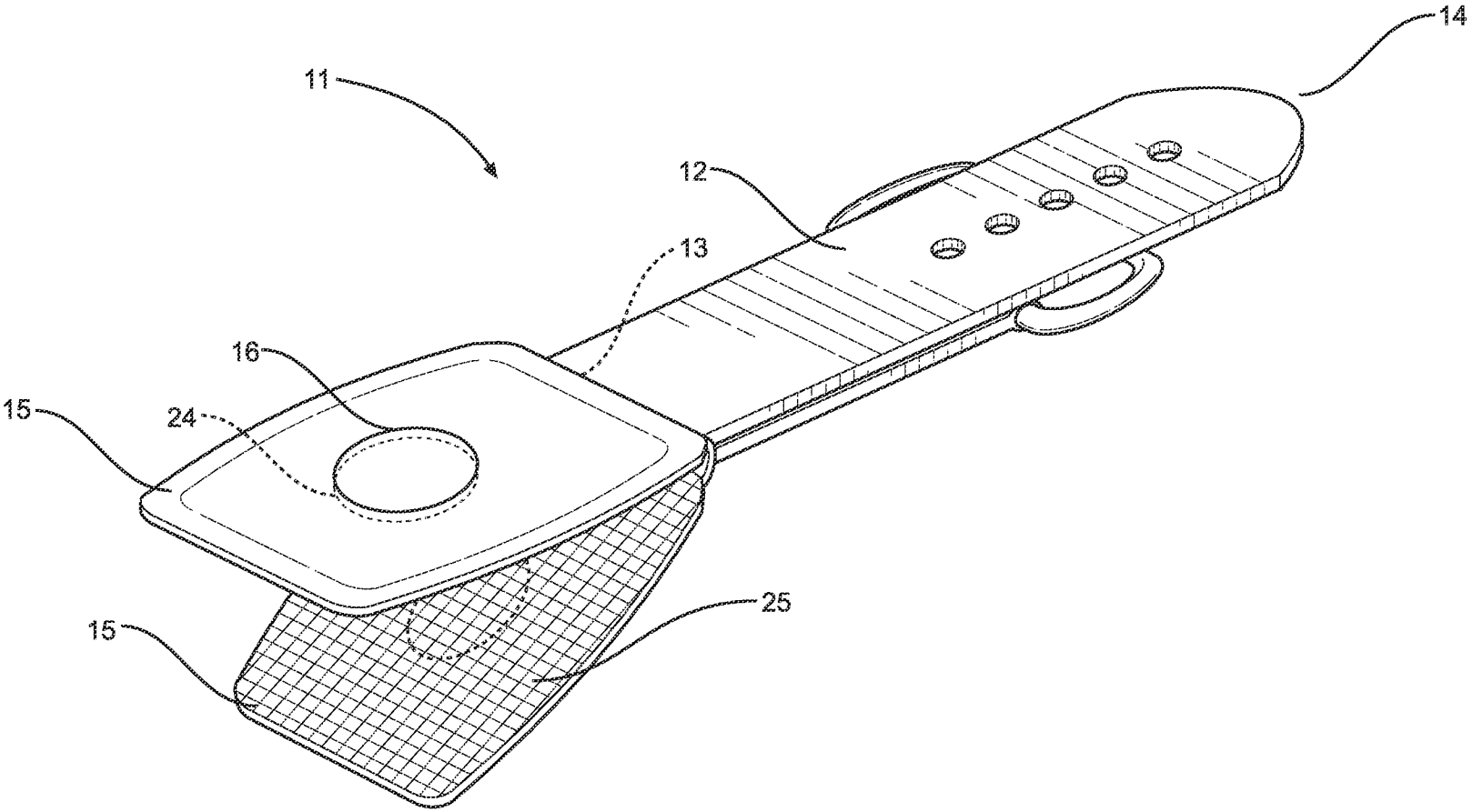
FIG. 1A shows a perspective view of the pair of fastener plates of an embodiment of the towel fastener in an open position.

Reference is made herein to the attached drawings. Like reference numerals are used throughout the drawings to depict like or similar elements of the towel fastener. The figures are intended for representative purposes only and should not be considered to be limiting in any respect.

Figure 1B:
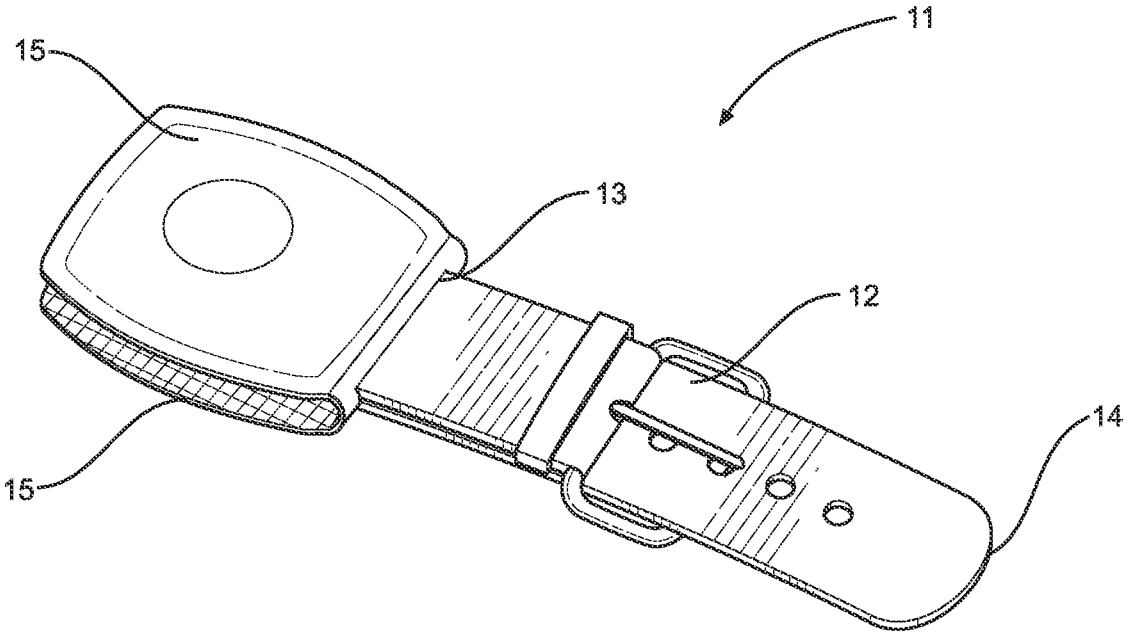
FIG. 1B shows a perspective view of the pair of fastener plates of an embodiment of the towel fastener in a closed position.

Referring now to FIGS. 1A and 1B, there is shown a perspective view of the pair of fastener plates of an embodiment of the towel fastener in an open position and a perspective view of the pair of fastener plates of an embodiment of the towel fastener in a closed position, respectively. The towel fastener 11 comprises a flexible strap 12 having a first end 13 opposite a second end 14. A pair of fastener plates 15 are pivotally affixed to the first end 13 of the flexible strap 12, such that the pair of fastener plates 15 are selectively movable between an open configuration (as shown in FIG. 1A) and a closed configuration (as shown in FIG. 1B). When in the closed configuration, an interior surface 25 of each of the pair of fastener plates 15 are disposed substantially parallel, such that a towel secured therebetween is frictionally engaged by each of the pair of fastener plates 15.

A complementary fastener 16 of a pair of complementary fasteners is disposed within each of the pair of fastener plates 15, wherein the pair of complementary fasteners are removably securable to each other to retain the pair of fastener plates 15 in the closed configuration. The complementary fasteners 16 are contemplated to comprise a magnetic fastener of sufficient strength to adhere to each other through an intervening fabric material, such as a towel, while still facilitating separation of the pair of fastener plates 15 via manual actuation. In the shown embodiment, each complementary fastener 16 is disposed centrally within each of the pair of fastener plates 15, such that the pair of fastener plates 15 extend from a perimeter of each of the complementary fasteners 16 to frictionally engage an item, such as a towel, therebetween. Furthermore, in the illustrated embodiment, a central recess 24 is disposed within each of the pair of fastener plates 15, wherein the central recess 24 is dimensioned to receive the complementary fastener 16 therein such that an upper surface of the complementary fastener 16 rests flush with the interior surface of each of the pair of fastener plates 15. In this manner, when the pair of complementary fasteners 16 are removably secured together, the surface area in contact with an item secured between the pair of fastener plates 15 is maximized to ensure retention of the item therebetween. In this manner, the item secured between the pair of fastener plates 15 is retained therebetween until the pair of fastener plates 15 are moved to the open configuration.

Figure 2A:
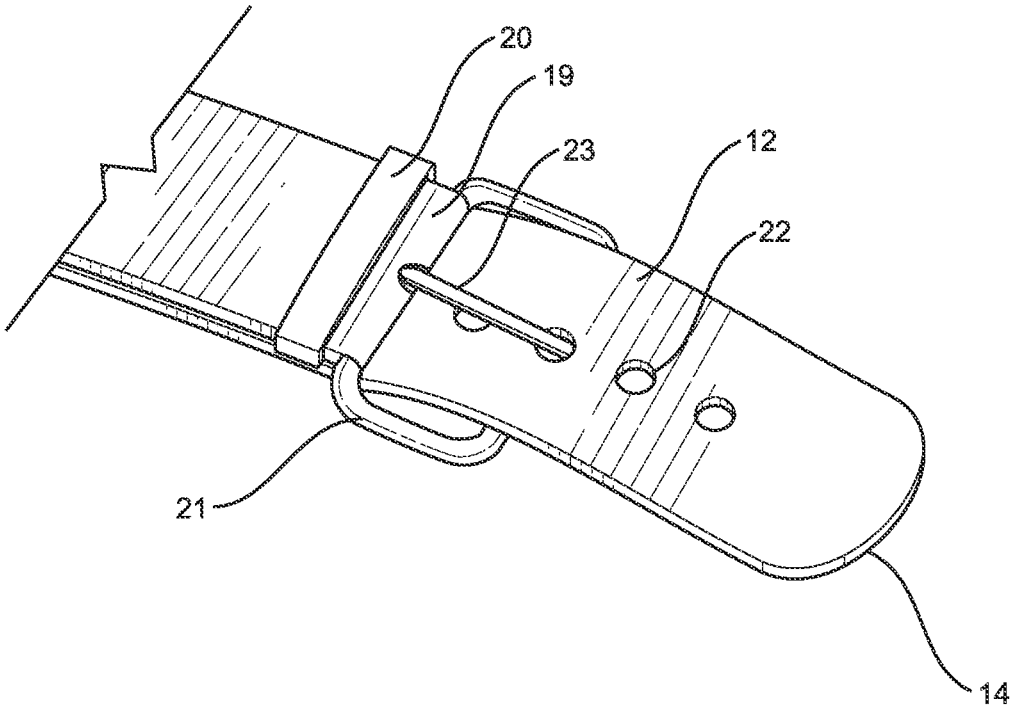
FIG. 2A shows a perspective view of the clasp of an embodiment of the towel fastener.
Figure 2B:
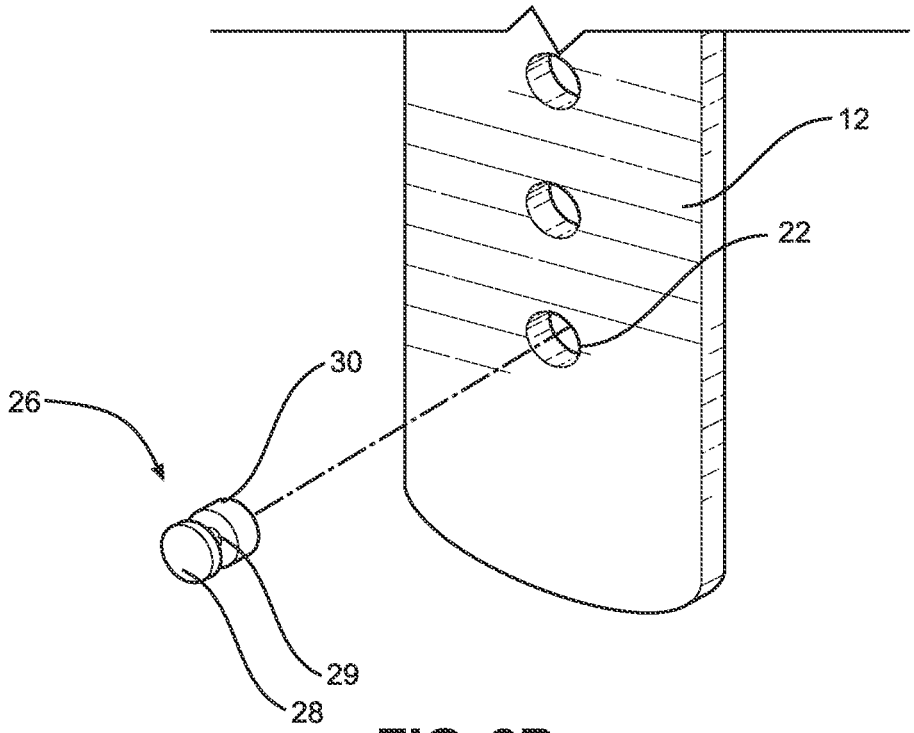
FIG. 2B shows an exploded view of the tongue of an embodiment of the towel fastener.
Figure 3A:
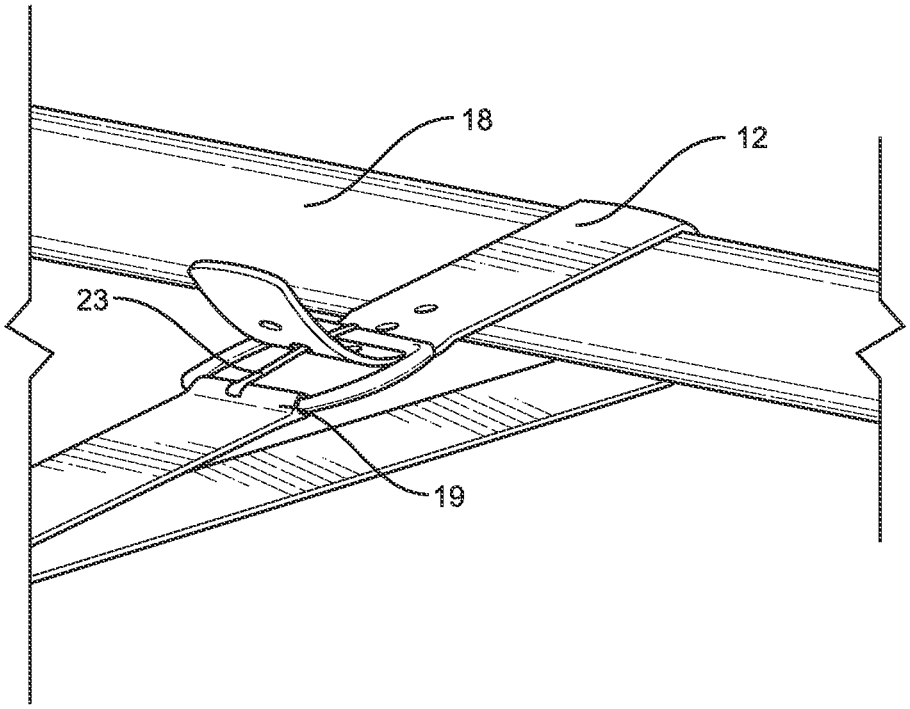
FIG. 3A shows a perspective view of an embodiment of the towel fastener secured about a rail.

Referring now to FIGS. 2A and 2B, there is shown a perspective view of the clasp of an embodiment of the towel fastener and an exploded view of the tongue of an embodiment of the towel fastener, respectively. In the illustrated embodiment of FIG. 2A, the flexible strap 12 further comprises a plurality of apertures 22 therethrough, wherein the plurality of apertures 22 are disposed linearly along the flexible strap 12 between the first end and the second end 14 thereof. In some embodiments, a clasp 19 is slidably disposed on the flexible strap 12, wherein the clasp 19 is configured to secure the flexible strap 12 in a looped configuration (as shown in FIG. 3A) about a support surface, such as a railing or the like. Alternatively, in the shown embodiment of FIG. 2A, the device comprises a secondary strap, wherein the clasp 19 is affixed to a distal end of the secondary strap. The clasp 19 further comprises a primary loop 20 slidably disposed about the flexible strap 12, wherein the position of the clasp 19 along the flexible strap 12 can be adjusted via sliding the primary loop 20 along a length of the flexible strap 12. A secondary loop 21 is pivotally affixed to the primary loop 20, wherein the secondary loop 21 is dimensioned to receive the second end 14 of the flexible strap 12 therethrough to place the flexible strap 12 in the looped configuration. In the shown embodiment, to facilitate the insertion of the second end 14 through the secondary loop 21, the second end 14 tapers inwardly such that the second end 14 terminates in a width less than that of the remainder of the flexible strap 12. Once placed in the looped configuration, an arm 23 pivotally affixed to the primary loop 20 can be inserted through an aperture of the plurality of apertures 22 to retain the flexible strap 12 in the looped configuration. Once secured, the secondary loop 21 can be folded towards the flexible strap 12 to reorient the arm 23 in such a way as to minimize the risk of disengagement of the arm 23 from the plurality of apertures 22. As such, the flexible strap 12 can be removably secured to a support surface, such as a railing, to secure a towel or other item thereto via the pair of fastener plates.

Alternatively, in the illustrated embodiment of FIG. 2B, a tongue 26 is affixed to the flexible strap 12, wherein the tongue 26 slidably engages with an existing track system (as shown in FIG. 2B), such as those utilized for securing a boat cover to a boat. In the shown embodiment, the tongue 26 comprises a substantially spool-like shape having a base 30 and a distal end 28 affixed together via a central portion 29, however, alternate tongue 26 configurations to engage within existing track systems of various boats or other vehicles are contemplated. In the shown embodiment, the tongue 26 comprises a base 30 dimensioned to removably secure within an aperture of the plurality of apertures 22 via frictional engagement. Alternatively, in other embodiments, the tongue 26 is integral with the flexible strap 12 to prevent unintentional disengagement of the tongue 26 from the flexible strap 12. The tongue 26 further comprises a distal end 28 affixed to the base 30 via a central portion 29, wherein the central portion 29 comprises a diameter less than that of the distal end 28 and the base 30. In this manner, the distal end 28 slidably engages within the track system in a manner that prevents the tongue 26 from disengaging from the track system via external forces substantially perpendicular to a longitudinal axis of the track system.

Figure 3B:
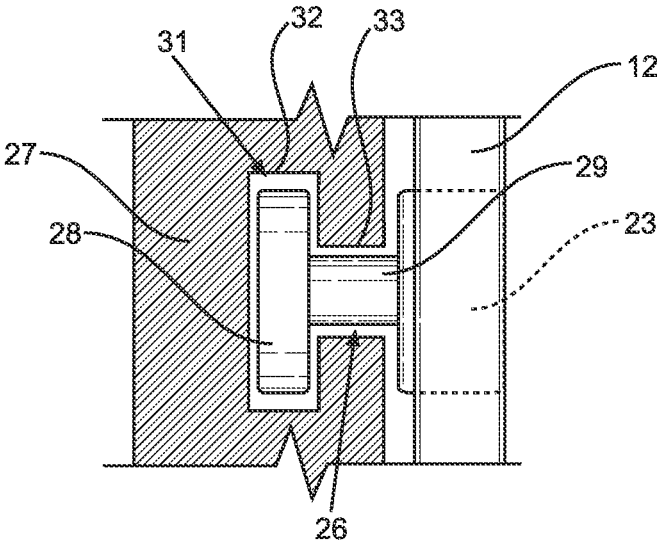
FIG. 3B shows a cross-sectional view of an embodiment of the towel fastener secured within a track system.

Referring now to FIGS. 3A and 3B, there is shown a perspective view of an embodiment of the towel fastener secured about a rail and a cross-sectional view of an embodiment of the towel fastener secured within a track system, respectively. In the illustrated embodiment of FIG. 3A, the towel fastener is secured about a support surface 18 such as a railing that may be commonly found along a perimeter of a boat or other open vehicle. The flexible strap 12 is placed in the looped configuration via inserting the second end of the flexible strap 12 through the clasp 19 and securing the arm 23 through an aperture of the plurality of apertures. In this manner, the flexible strap 12 can be secured about the support surface 18 to prevent a towel or other item secured between the pair of fastener plates therebetween. Once secured in such a fashion, the user can then orient the clasp 19 to minimize the risk of disengagement of the arm 23 from the flexible strap 12 as previously described herein.

In the illustrated embodiment of FIG. 3B, an existing track system 27 is in cooperation with the tongue 26 of the previously described embodiment shown in FIG. 2B. In such an embodiment, the base of the tongue 26 is removably secured within an aperture of the plurality of apertures 22 disposed within the flexible strap 12. In the shown embodiment, the track system 27 comprises a channel 31 extending along a longitudinal axis of the channel 31, wherein the channel 31 includes an interior portion 32 and an exterior portion 33. The interior portion 32 comprises a greater width than that of the exterior portion 33, such that the tongue 26 is retained within the channel 31. As such, the interior portion 32 is dimensioned to slidably receive the distal end 28 of the tongue 26 therein, and the exterior portion 33 is dimensioned to receive the central portion 29 therein. In this manner, the tongue 26 is retained within the channel 31 during use, thereby slidably securing the flexible strap 12 to the track system 27. As such, the towel fastener can be positioned along the perimeter of the boat or other open vehicle as desired.

Figure 4:
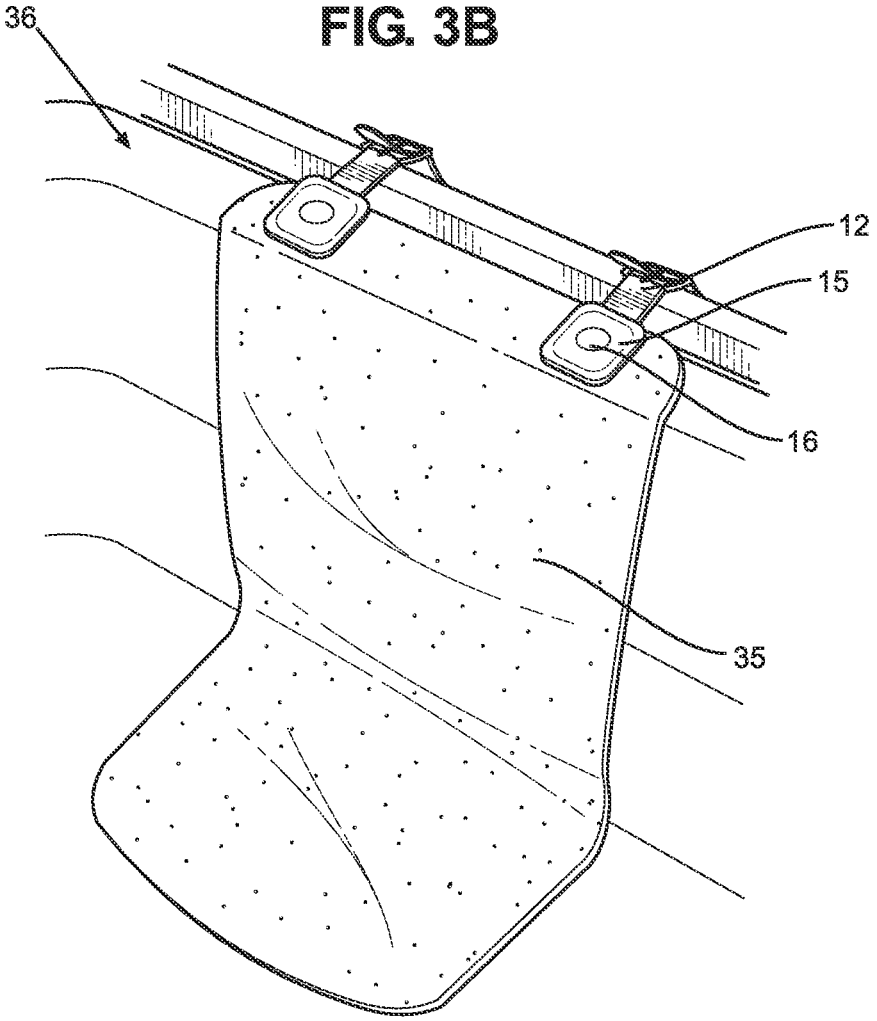
FIG. 4 shows a perspective view of an embodiment of the towel fastener in use.

Referring now to FIG. 4, there is shown a perspective view of an embodiment of the towel fastener in use. In one use, the flexible strap 12 is secured to a vehicle 36, such as a boat via securing the flexible strap 12 about a support surface in a looped configuration, or via engagement within a track system disposed about the vehicle 36 as previously described herein. Additional towel fasteners can be similarly secured about the vehicle 36 to provide multiple points of contact between a towel 35 or other item a user desires to secure to the vehicle 36. The pair of fastener plates 15 can then be positioned in the open configuration, thereby allowing a user to secure a towel 35 or other item therebetween. The pair of fastener plates 15 can then be pivoted to the closed position such that the pair of complementary fasteners 16 removably secure to each other to retain the towel 35 therebetween. In this manner, the towel 35 is retained within the vehicle 36 during operation, such that movement, wind, or other conditions cannot displace the towel 35 from the desired location on the vehicle 36. Alternatively, in some embodiments, the pair of fastener plates 15 are integrally affixed to an existing towel 35, such that the towel 35 is removably securable to the vehicle 36 via the flexible strap 12 and an associated securement device, such as the clasp or tongue as previously described herein. In such embodiments, the towel fastener system comprises a pair of towel fasteners integrally affixed to opposing corners of the towel 35, thereby ensuring that the towel 35 is securely affixed to the vehicle 36.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towel fastener, comprising:

a flexible strap having a first end opposite a second end;

a pair of fastener plates hingedly affixed to the first end of the flexible strap;

wherein the pair of fastener plates are selectively movable between an open position and a closed position;

wherein the pair of fastener plates are substantially parallel when in the closed position;

a pair of complementary fasteners;

wherein one of said complementary fastener is disposed on each said fastener plate of the pair of fastener plates, such that the pair of fastener plates are removably securable in the closed position;

a tongue disposed on the flexible strap; and wherein the tongue slidably secures within a track system.

2. The towel fastener of claim 1, wherein the pair of complementary fasteners comprise magnetic fasteners.

3. The towel fastener of claim 1, wherein the pair of complementary fasteners are disposed within a central recess of each fastener plate, such that the pair of complementary fasteners rest flush with an interior surface of each fastener plate.

4. The towel fastener of claim 1, wherein the pair of fastener plates comprise a larger cross-sectional area than each of the pair of complementary fasteners.

5. The towel fastener of claim 1, wherein the tongue is removably securable within one of a plurality of apertures disposed along a length of the flexible strap.

6. The towel fastener of claim 1, wherein the track system comprises a channel having an interior portion larger than an exterior portion of the channel.

7. The towel fastener of claim 1, wherein the second end of the flexible strap tapers to a width less than that of the first end of the flexible strap.

* * * * *